US008263204B2

(12) United States Patent
Higashinaka et al.

(10) Patent No.: US 8,263,204 B2
(45) Date of Patent: Sep. 11, 2012

(54) HOOK SURFACE FASTENER

(75) Inventors: Yukitoshi Higashinaka, Fukui (JP); Hiroshi Itoh, Nara (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 582 days.

(21) Appl. No.: 12/513,868

(22) PCT Filed: Nov. 16, 2007

(86) PCT No.: PCT/JP2007/072283

§ 371 (c)(1),
(2), (4) Date: May 7, 2009

(87) PCT Pub. No.: WO2008/059958

PCT Pub. Date: May 22, 2008

(65) Prior Publication Data

US 2010/0043183 A1 Feb. 25, 2010

(30) Foreign Application Priority Data

Nov. 17, 2006 (JP) ..... 2006-311512

(51) Int. Cl.
*A44B 18/00* (2006.01)
*B32B 3/04* (2006.01)

(52) U.S. Cl. ..... 428/100; 428/99; 24/452; 24/451

(58) Field of Classification Search ..... 428/100, 428/99; 442/199, 200; 24/452, 442, 445, 24/447, 448, 451
See application file for complete search history.

(56) References Cited

U.S. PATENT DOCUMENTS

| | | | | |
|---|---|---|---|---|
| 3,138,841 | A * | 6/1964 | Naimer | 24/450 |
| 4,290,174 | A * | 9/1981 | Kalleberg | 24/444 |
| 4,454,183 | A * | 6/1984 | Wollman | 428/92 |
| 4,920,617 | A * | 5/1990 | Higashinaka | 24/442 |
| 5,231,738 | A * | 8/1993 | Higashinaka | 24/446 |
| 5,369,852 | A * | 12/1994 | Higashinaka | 24/446 |
| 5,473,800 | A * | 12/1995 | Hatomoto et al. | 24/442 |
| 5,515,583 | A * | 5/1996 | Higashinaka | 24/446 |
| 5,654,067 | A | 8/1997 | Dinger et al. | |
| 6,386,242 | B1 * | 5/2002 | Higashinaka et al. | 139/391 |
| 7,193,010 | B2 * | 3/2007 | Kato et al. | 524/591 |
| 7,981,822 | B2 * | 7/2011 | Lester et al. | 442/411 |
| 2003/0027968 | A1 * | 2/2003 | Kato et al. | 528/44 |
| 2003/0186021 | A1 * | 10/2003 | Tanaka et al. | 428/97 |
| 2004/0166282 | A1 * | 8/2004 | Kingsford et al. | 428/95 |
| 2006/0019053 | A1 * | 1/2006 | Jacoby et al. | 428/40.1 |
| 2006/0019572 | A1 * | 1/2006 | Lester et al. | 442/411 |
| 2008/0289157 | A1 * | 11/2008 | Higashinaka et al. | 24/445 |
| 2010/0287743 | A1 * | 11/2010 | Higashinaka et al. | 24/442 |

FOREIGN PATENT DOCUMENTS

| | | |
|---|---|---|
| JP | 04 065521 | 3/1992 |
| JP | 07 011556 | 1/1995 |
| JP | 8 280418 | 10/1996 |
| JP | 2001 123324 | 5/2001 |

* cited by examiner

*Primary Examiner* — Cheryl Juska
(74) *Attorney, Agent, or Firm* — Oblon, Spivak, McClelland, Maier & Neustadt, L.L.P.

(57) ABSTRACT

A hook surface fastener excellent in the heat resistance, flame resistance, retention of hook shape, and pull-out resistance of hook engaging elements (fibers). The hook surface fastener is composed of a base fabric and the hook engaging elements formed on the base fabric. The base fabric is a woven fabric composed of warp yarns, weft yarns and fibers constituting the hook engaging elements. The warp yarns and the fibers constituting the hook engaging elements are polyphenylene sulfide fibers. The weft yarns are substantially non-twisted, paralleled yarns of polyphenylene sulfide fibers and heat-fusible fibers having a melting point or softening point each being 230° C. or lower. The polyphenylene sulfide fibers constituting the hook engaging elements have a crystal orientation of 85.0 to 90.0% and a crystallinity of 32.0 to 42.0% so that the retention of hook shape is good. The fibers constituting the hook engaging elements are anchored to the base fabric by fusion of the heat-fusible fibers. Therefore, the pull-out resistance of the hook engaging elements (fibers) is good even if a resin coat layer is substantially not provided on the back surface of the base fabric. A hook surface fastener substantially free from the resin coat layer has a good heat resistance and flame resistance.

4 Claims, No Drawings

HOOK SURFACE FASTENER

TECHNICAL FIELD

The present invention relates to a hook surface fastener which is composed of a base fabric made of a woven fabric and hook engaging elements formed on the base fabric, and more particularly to a hook surface fastener excellent in heat resistance, flame resistance, retention of hook shape, and pull-out resistance (resistance of the hook engaging elements and fibers forming the hook engaging elements to being pulled out of the base fabric).

BACKGROUND ART

Surface fasteners have been widely used in various applications as a fastening means which is easy to engage and disengage and can be repeatedly used. Cloth hook surface fasteners and cloth loop surface fasteners, which are composed of a base fabric formed from woven fibers or knitted fibers and hook engaging elements or loop engaging elements projecting from the surface of the base fabric, have been widely used in articles for daily use or business use such as clothes, briefcases and bags.

The cloth hook surface fastener for daily use is sometimes required to withstand the ironing temperature, and the cloth hook surface fastener for business use is sometimes required to have a heat resistance enough to withstand the high-temperature environment. Since the ironing temperature is about 200° C. at highest, a known hook surface fastener made of polyester fibers manages to withstand the ironing temperature. However, since the engaging elements gradually lose their shapes and engaging performance after repeated ironing, a further improved heat resistance is still required. In addition, the hook surface fastener is sometimes used in an environment of 200° C. or higher for a long period of time in the business application. Therefore, a hook surface fastener which maintains the engaging performance even under a high-temperature environment is keenly required. The known hook surface fastener made of polyester fibers cannot meet the requirements in the business application. Further, a still higher heat resistance and flame resistance come to be required in some applications such as fireman uniform.

In addition, the hook engaging elements are pulled during the repeated engagement-disengagement operations of the hook surface fastener and the loop surface fastener and the hook engaging elements are pulled out of the base fabric of the fastener in some cases. To avoid this problem, the hook engaging elements are generally anchored to the base fabric by coating an adhesive resin on the back surface of the base fabric. However, the adhesive resin coat on the back surface of the base fabric reduces the heat resistance and the flame resistance of the surface fastener, and in many cases, deteriorates the flexibility of the surface fastener.

It has been reported that a surface fastener made of filaments having a melting point of 250° C. or higher and binder fibers for fusion-bonding the filaments has an improved heat resistance (Patent Document 1). As the high-melting point filaments, fibers of a polyester-based polymer and fibers of other polymers such as a liquid crystal polymer, polybenzimidazole and polyphenylene sulfide (PPS) are described (paragraph 0073). However, only a surface fastener made of polyester fibers is actually disclosed in the working examples of Patent Document 1. While a surface fastener made of other types of fibers, particularly, made of PPS fibers is noted in the broad teachings, Patent Document 1 provides no further teaching and addresses nothing about such a surface fastener.

Patent Document 2 discloses PPS monofilaments which exhibit an extremely high heat stability such as a high retention of tensile strength even after a long use at high temperatures. It is taught that the PPS monofilaments are produced by spinning, drawing and heat-treating at about 120 to 280° C. under about 0.8 to 1.0 times of tension. However, the heat treatment actually made in the working examples is performed only at 180° C. after spinning and drawing (paragraph 0043). In the examples of Patent Document 2, the variation of fiber diameter after the heat treatment at 250° C. for 400 h is described. However, the long-time heat treatment is made for only evaluating the variation of fiber properties and clearly distinguished from the heat treatment employed in the present invention for improving the engaging performance of the hook engaging elements.

Patent Document 1: JP 8-280418A (paragraph 0073)

Patent Document 2: JP 2001-123324A (paragraph 0043)

DISCLOSURE OF THE INVENTION

As a result of research on seeking a hook surface fastener excellent in the heat resistance, flame resistance, retention of hook shape, and pull-out resistance of hook engaging elements (fibers), the inventors have found that the heat resistance is improved in some degree by the use of PPS fibers. To maintain the engaging performance, it is necessary to retain the shape of the crooked heads of the hook engaging elements even after the repeated engagement-disengagement operations at high temperatures. It has been found that the retention of hook shape is improved and the engaging performance is maintained longer than ever if the hook engaging elements are made of PPS fibers having specific properties. As mentioned above, if the back surface of base fabric is, as employed in the conventional technique, coated with an adhesive resin to anchor the hook engaging elements to the base fabric, the heat resistance and flame resistance of the surface fastener are reduced. To avoid such drawbacks and ensure the heat resistance and flame resistance simultaneously with the pull-out resistance by utilizing PPS fibers without lessening their effects, a method replacing the conventional method of coating an adhesive resin should be employed. It has been found highly effective as such a method to form the base fabric partly form heat-fusible fibers (binder fibers).

Thus, the present invention provides a hook surface fastener comprising a base fabric and hook engaging elements formed on the base fabric, the hook surface fastener satisfying the following requirements 1 to 5 simultaneously:

(1) the base fabric is a woven fabric comprising warp yarns, weft yarns and fibers constituting the hook engaging elements, and the warp yarns and the fibers constituting the hook engaging elements are polyphenylene sulfide fibers;

(2) the polyphenylene sulfide fibers constituting the hook engaging elements have a crystal orientation of 85.0 to 90.0% and a crystallinity of 32.0 to 42.0%;

(3) the weft yarns are substantially non-twisted, paralleled yarns comprising polyphenylene sulfide fibers and heat-fusible fibers having a melting point or a softening point each being 230° C. or lower;

(4) a ratio of the heat-fusible fibers to the fibers constituting the base fabric is 10 to 25% by weight wherein the fibers constituting the base fabric are total of the warp yarns and the weft yarns exclusive of the fibers constituting the hook engaging elements, and the fibers constituting the hook engaging elements are anchored to the base fabric by fusion of the heat-fusible fibers; and (5) substantially no resin coat layer is provided on a back surface of the base fabric.

BEST MODE FOR CARRYING OUT THE INVENTION

The hook surface fastener of the invention comprises a woven base fabric and hook engaging elements formed on the base fabric. Both the woven base fabric and the hook engaging elements are constituted by PPS fibers. PPS fibers, particularly preferably PPS multifilaments are used as warp yarns and weft yarns for the woven base fabric. PPS fibers, particularly preferably PPS monofilaments are used as the fibers for forming loops (loop fibers) which are made into the hook engaging elements in a later stage. These fibers are woven by a known method and finally made into the hook surface fastener. The present invention will be described below in detail.

PPS fibers used in the present invention are produced by melt-spinning PPS having a weight average molecular weight of 20,000 to 100,000, drawing the spun fibers at a predetermined ratio, and optionally heat-treating the drawn fibers, and selected from those commercially available. PPS fibers used as the raw material are not needed to have a crystal orientation and a crystallinity each being within the ranges specified in the present invention. If not being within the ranges specified in the present invention, the crystal orientation and crystallinity of commercially available PPS fibers can be made within the rages specified in the invention by the specific heat treatment mentioned below. Therefore, it is preferred to select PPS fibers while taking the heat treatment to be performed later into consideration.

Particularly preferred PPS fibers for the warp yarns which form the woven base fabric are PPS multifilaments of 150 to 300 dtex/10 to 80 filaments (total dtex of multifilaments/number of filaments in multifilaments, the same being applied below). PPS multifilaments for the warp yarns are preferably twisted at a twist number of 100 to 800 turns/m in view of the weaving ability.

PPS fibers for the weft yarns which form the woven base fabric are substantially non-twisted, paralleled yarns composed of PPS fibers and heat-fusible fibers (hereinafter referred to also as "binder fibers") having a melting point or a softening point each being 230° C. or lower. Particularly preferred PPS fibers are PPS multifilaments of 150 to 300 dtex/5 to 50 filaments. PPS multifilaments for the weft yarns are preferably substantially non-twisted yarns because the binder effect of the binder fibers to be paralleled with the multifilaments is enhanced.

The binder fibers have a relatively high heat resistance and a melting point or a softening point each being 230° C. or lower, preferably 120 to 230° C., more preferably 120 to 200° C., and still more preferably 120 to 160° C. The binder fibers are more preferably core-sheath composite fibers (core component/sheath component=75/25 to 30/70 by weight) having a sheath component comprising a low-melting point or low-softening point polyester and a core component comprising a high-melting point polyester. The melting point or softening point of the sheath component polyester is preferably 230° C. or lower, more preferably 120 to 230° C., still more preferably 120 to 200° C., and particularly preferably 120 to 160° C. The melting point of the core component polyester is higher than the melting point or softening point of the sheath component polyester preferably by about 20° C. or more and particularly preferably by 20 to 120° C. Examples of the sheath component polyester include polyethylene terephthalate and polybutylene terephthalate each being copolymerized with an aromatic dicarboxylic acid such as isophthalic acid and sodium sulfoisophthalate, an aliphatic dicarboxylic acid such as adipic acid and sebacic acid, or an alkylene glycol such as propylene glycol and butylene glycol. The content of the co-monomer in the dicarboxylic acid component or diol component is preferably 20 to 50 mol %. Example of the core component polyester include polyethylene terephthalate that is substantially not copolymerized (the content of co-monomer is 15 mol % or less, preferably a homopolymer containing no copolymerized component). The binder fibers are preferably multifilaments (number of filaments=12 to 60) composed of filaments each having a single fiber fineness of 2 to 6 dtex. The binder fibers are not particularly limited to those described above as long as the effect of anchoring the hook engaging elements to be described below is ensured.

If paralleled yarns of two or more kinds of fibers are used as the weft or warp, the paralleled yarns are generally twisted so as to enhance the weaving ability. In contrast, in the present invention, the paralleled yarns of PPS fibers and the binder fibers are used as the weft yarns in the state substantially not twisted. In the present invention, the term "substantially non-twisted" means the number of twist of 0 to 50 turns/m, preferably 0 to 30 turns/m. If twisted paralleled yarns of several hundreds to 2000 turns/m employed in the conventional technique are used as the weft yarns, the effect of the paralleled yarns to anchor the warp yarns and the hook engaging elements by heat fusion is largely reduced. When the paralleled yarns of the binder fibers and PPS fibers are not twisted, the warp yarns and the hook engaging elements are effectively heat-anchored even if the amount of the binder fibers used is small, and the pull-out resistance of the hook engaging elements is enhanced without reducing the flame resistance.

In the paralleled yarn, the weight ratio of PPS fibers (for example, PPS multifilaments) and the binder fibers (for example, polyester multifilaments) is preferably 4:1 to 1:1 and more preferably 2:1 to 1:1.

The fibers (loop fibers) to be made into the hook engaging elements are preferably PPS monofilaments as mentioned above and more preferably PPS monofilaments of 200 to 600 dtex. The PPS resins and PPS fibers for use as the warp yarns, weft yarns and loop fibers may be the same or different. A part of the warp yarns and weft yarns may be replaced by fibers which do not ruin the effect of the invention significantly, for example, a small amount of heat-resistant organic fibers.

The hook surface fastener of the invention is produced by a step of weaving the warp yarns, weft yarns and the loop fibers to obtain a woven fabric (loop woven fabric) having loops upwardly projecting from the surface thereof; a step of heat-treating the loop woven fabric; and a step of cutting the loops at their sides to form the hook engaging elements. In view of the pull-out resistance, the loop fibers are used preferably as a part of the warp yarns. The fabric density is preferably 25 to 65 yarns/cm for the warp yarns and 13 to 20 yarns/cm for the weft yarns. It is preferred to use one loop fiber per 2 to 5 warp yarns. The number of the weft yarns mentioned above is for situations where the weft yarns are shot from only one side of the fabric and a pair of weft yarns crossing the fabric back and forth is counted as one yarn. The loop fibers are woven preferably so as to form the loops which upwardly project from the surface of the woven base fabric at a high of 1 to 3 mm. The woven structure is preferably a usual plain weave. The weaving method for producing the loop woven fabric is not specifically limited and a known method for the production of woven fabrics is employed.

An increased amount of the binder fibers used is generally preferred in view of the pull-out resistance of the hook engaging elements, because the effect of anchoring the fibers to the base fabric is increased as the amount is increased. However, the flame resistance is reduced with increasing amount of the binder fibers. As a result of research for seeking a hook surface fastener which has a high anchoring effect and an excellent pull-out resistance of hook engaging elements even when the amount of the binder fibers used is relatively small, the inventors have reached the use of substantially non-twisted, paralleled yarns of the binder fibers and PPS fibers as the weft yarns. Therefore, it is necessary in the present invention to use the binder fibers in an amount of 10 to 25% by weight of the total amount of the fibers constituting the woven base fabric (the total weight of the warp yarns and the weft yarns of the base fabric and the fibers constituting the hook engaging elements are excluded). If less than 10% by weight, the loops may be pulled out in a later stage of cutting the loop fibers or the hook engaging elements may be easily pulled out of the woven base fabric because the anchoring effect by fusion of the binder fibers is insufficient. No additional anchoring effect by fusion is obtained even if exceeding 25% by weight. In addition, the woven base fabric becomes hard to make the attachment of the hook surface fastener by sewing difficult, the problems of melting at low temperatures is caused and the amount of combustible component is increased. Since the binder fibers are used in a limited amount within the above range, the hook surface fastener of the invention having substantially no resin coat layer on the bask surface (surface opposite to the surface of hook engaging elements) has, in addition to the heat resistance, a flame resistance rated as noncombustible or fire-retardant even upon contact with flame.

Then, the obtained loop woven fabric is heat-treated to anchor the fibers and fix the shape of loops. Thereafter, the loops are cut at one or two points of their sides by a clipper to form the hook engaging elements. The hook engaging elements should be anchored to the base fabric. In the known cloth surface fasteners, the hook engaging elements are anchored by the resin coat layer to prevent the pull-out. The resin coat layer is formed by applying a resin solution or a resin emulsion onto the back surface of the base fabric. However, the resin coat layer reduces the heat resistance. In the present invention, as mentioned above, to firmly anchor the hook engaging elements without forming the resin coat layer, the weft yarns containing the binder fibers are used and at least the surface of the binder fibers are fused by the heat treatment, thereby anchoring the feet of the hook engaging elements to the woven base fabric by fusion bonding. If a heat resistance not so high is acceptable, a small resin coat layer may be formed in addition to the use of the binder fibers. However, a hook surface fastener completely free from the resin coat layer is more preferred.

The hook surface fastener produced by the above method has an excellent heat resistance, but the engaging force has been found to be lowered because of the loss of the shape of the hook engaging elements when placed in a high-temperature atmosphere of about 200° C. for a long period of time or after repeated ironings. To obtain a hook surface fastener made of PPS fibers which withstands the practical use, such a problem must be solved.

As a result of further research on the anchoring of the hook engaging elements made of PPS fibers by heating, it has been found that the crooks of the hook engaging elements hardly loose their shape if the crystal orientation and the crystallinity of PPS fibers are within the specific ranges. Namely, PPS fibers for forming the hook engaging elements has a crystal orientation of 85.0 to 90.0% and preferably 88.5 to 90.0% and a crystallinity of 32.0 to 42.0% and preferably 33.0 to 40.0%.

If the crystal orientation exceeds 90.0% or the crystallinity is less than 32.0%, the shape of crooks is largely deformed in high-temperature atmosphere to lose the engaging performance. If the crystal orientation is less than 85.0% or the crystallinity exceeds 42.0%, the flexibility of the hook engaging elements is reduced to largely reduce the engaging force after repeated engagement-disengagement operations with loop engaging elements.

The crystal orientation and crystallinity within the above ranges are achieved by conducting the heat treatment of the loop woven fabric for anchoring the fibers and fixing the loop shape under dry heat treatment conditions at about 230 to 260° C. for about 1 to 2 min. PPS fibers before weaving may be subjected to the above heat treatment. However, it is advantageous in view of productivity to heat-treat the loop woven fabric, because the anchoring of the fibers and the fixing of the loop shape can be simultaneously effected. Most of commercially available PPS fibers not subjected to the above heat treatment, as-spun PPS fibers or as-drawn PPS fibers have a crystal orientation of 91% or more or a crystallinity of 30% or less, and fail to have both the crystal orientation and the crystallinity required in the present invention.

PPS fibers for the warp yarns or the weft yarns may satisfy or not satisfy the above requirements on the crystal orientation and the crystallinity.

The hook engaging elements formed after the above heat treatment have a moderate bending stiffness (flexural rigidity). If the bending stiffness is excessively high, the hook engaging elements are brittle and easy to be broken, thereby reducing the repeated number of better engagement-disengagement operations with the loop engaging elements. The bending stiffness of the hook engaging elements (PPS fibers) of the invention is preferably 0.015 to 0.018 gf·cm$^2$/cm. If exceeding 0.018 gf·cm$^2$/cm, the hook engaging elements are easy to be broken. If less than 0.015 gf·cm$^2$/cm, the hook engaging elements are easy to lose their shape. The bending stiffness within the above range, even when commercially available PPS fibers are used, can be obtained by the above heat treatment.

The thickness of the woven base fabric of the hook surface fastener is preferably 0.2 to 0.5 mm. The hook engaging elements are formed on the woven base fabric preferably in a density of 30 to 70/cm$^2$. The mass per unit area of the woven base fabric is preferably 250 to 450 g/m$^2$ in view of the engaging performance and the feel. On one or both surfaces of the woven base fabric, only the hook engaging elements may be formed. Alternatively, the hook engaging elements and the loop engaging elements may be mixedly formed on one or both surfaces. Thus, the present invention includes a single type, double type, single mixed type, and double mixed type hook surface fasteners wherein one surface/the other surface is hook engaging elements/no engaging element, hook engaging elements/hook engaging elements, hook engaging elements/loop engaging elements, (hook engaging elements+loop engaging elements)/no engaging element, (hook engaging elements+loop engaging elements)/hook engaging elements, (hook engaging elements+loop engaging elements)/loop engaging elements, (hook engaging elements+loop engaging elements)/(hook engaging elements+loop engaging elements), etc.

EXAMPLES

Preferred embodiments and effects of the present invention will be described in detail with reference to the examples and comparative examples. However, it should be noted that the scope of the present invention is not limited to the following examples. The properties were measured by the following methods.

(1) Crystal Orientation and Crystallinity

An X-ray diffraction photograph of hook engaging elements (PPS fibers) was taken using an X-ray diffractometer (SWXD-FK) manufactured by Rigaku Corporation under the conditions of a voltage of 20 kV, a current of 10 mA and an exposure time of 20 min. The crystal orientation and crystallinity were calculated from the X-ray diffraction photograph.

(2) Bending Stiffness

A sample was prepared by aligning ten 5-cm long hook engaging elements (PPS fibers) side-by-side in an overall distance of 2.5 cm at equal intervals. The sample was bent using KES bending tester "KFS-FB2" manufactured by KES Kato Tech Co., Ltd. to measure the flexural rigidity.

(3) Engaging Performance

Measured according to JIS-L-3416 using a hook surface fastener and a loop surface fastener each having a width of 25 mm.

(4) Melting Point or Softening Point

The resin for the binder fibers was measured for the melting point or softening point according to JIS-K-0064 using an automatic melting point apparatus based on a light transmission method ("FP62" manufactured by Mettler Toledo International Inc.).

Example 1

The following warp yarns, weft yarns and loop fibers were woven into a loop woven fabric.

(1) Warp Yarns

Twisted Yarns of 500 turns/m

PPS multifilaments (250 dtex/60 filaments: "Procon T/#40 G250-60-PFD" (tradename) manufactured by Toyobo Co., Ltd.).

(2) Weft Yarns: Non-Twisted, Paralleled Yarns

PPS multifilaments (167 dtex/10 filaments: "Procon T/#7 G167-10-PFD" (tradename) manufactured by Toyobo Co., Ltd.) having a number of twist of about 10 turns/m naturally occurred during the running of yarns.

Heat-fusible multifilaments (84 dtex/24 filaments).

sheath component: low-melting point copolymerized polyethylene terephthalate (PET).

co-monomer: isophthalic acid (25 mol %)

melting point: 155° C.

core component: high-melting point non-copolymerized PET.

melting point: 260° C.

Amount of heat-fusible fibers used: 12% by weight of total weight of base fabric.

(3) Loop Fibers

PPS monofilaments ("KPS Yarn 0.20 mm, 5P" (tradename) manufactured by Kureha Gohsen Co., Ltd.).

diameter: 0.20 mm (380 dtex)

crystal orientation: 92% crystallinity: 25%

The fabric density was 56 yarns/cm for the warp yarns and 17 yarns/cm for the weft yarns. One loop monofilament was used per four warp yarns. The weft yarns were shot from only one side of the fabric and allowed to go back and forth across the fabric. The above weft density of 17 yarns/cm was determined by counting a pair of yarns crossing the fabric back and forth as one weft yarn (the same is applied below). The height of loop was 2 mm and the density of loops formed was 50 per 1 $cm^2$ of the base fabric. The obtained loop woven fabric was heat-treated with a hot air at 250° C. for 1 min, and then, the loops were cut at one side to form hook engaging elements, thereby obtaining a hook surface fastener. The obtained hook engaging elements had a crystal orientation of 89.6%, a crystallinity of 34.2%, and a bending stiffness (flexural rigidity) of 0.016 gf·$cm^2$/cm.

A loop surface fastener cooperating with the obtained hook surface fastener was produced as follows. First, the following warp yarns, weft yarns and loop fibers were woven into a loop woven fabric.

(1') Warp Yarns

PPS multifilaments (250 dtex/60 filaments) mentioned above.

(2') Weft Yarns: Non-twisted, paralleled yarns

PPS multifilaments (167 dtex/10 filaments) mentioned above.

Heat-fusible multifilaments (84 dtex/24 filaments).

sheath component: low-melting point copolymerized PET (melting point: 155° C.) mentioned above.

core component: high-melting point non-copolymerized PET (melting point: 260° C.) mentioned above.

Amount of heat-fusible fibers used: 12% by weight of total weight of base fabric (3') Loop Fibers PPS multifilaments (167 dtex/10 filaments) mentioned above.

The fabric density was 52 yarns/cm for the warp yarns and 18 yarns/cm for the weft yarns. One loop multifilament was used per four warp yarns. The height of loop was 2.5 mm and the density of loops formed was 53 per 1 $cm^2$ of the base fabric. The obtained loop woven fabric was heat-treated with a hot air at 250° C. for 1 min to produce a loop surface fastener.

The hook surface fastener and the loop surface fastener were measured for the engaging performance. The tensile shear strength was 8.7 N/$cm^2$ and the peeling strength was 1.4 N/cm. After repeating the engagement-disengagement operations 1000 times, the tensile shear strength was 5.4 N/$cm^2$ and the peeling strength was 1.1 N/cm. The retention of the engaging force after repeating the engagement-disengagement operations 1000 times was 60% or more, showing that the hook engaging elements were excellent also in the pull-out resistance.

After standing in a hot air at 230° C. for 24 h, the engaged hook surface fastener/loop surface fastener was measured at 20° C. for the engaging performance. The tensile shear strength was 8.4 N/$cm^2$, the peeling strength was 1.0 N/cm, and the retention of the engaging force under heating was 70% or more. The shape of hooks little changed after standing in a hot air. Therefore, the easiness of engaging and the engaging strength were little affected by the deformation of hooks The hook surface fastener was brought into contact with the flame of a gas burner for 20 s. When separating the hook surface fastener from the flame, the fire extinguished oneself with little smoking, showing that the hook surface fastener was excellent also in the flame resistance.

Example 2

The following warp yarns, weft yarns and loop fibers were woven into a loop woven fabric in the same manner as in Example 1.

(1) Warp Yarns

PPS multifilaments (250 dtex/60 filaments) as used in Example 1.

(2) Weft Yarns: Non-Twisted, Paralleled Yarns

PPS multifilaments (167 dtex/10 filaments) as used in Example 1.

Heat-fusible multifilaments (167 dtex/48 filaments).

sheath component: low-melting point copolymerized PET (melting point: 155° C.) as used in Example 1.

core component: high-melting point non-copolymerized PET (melting point: 260° C.) as used in Example 1.

Amount of heat-fusible fibers used: 22% by weight of total weight of base fabric.

(3) Loop Fibers

PPS monofilaments (380 dtex) having a diameter of 0.20 mm.

crystal orientation: 91% crystallinity: 23%

The obtained loop woven fabric was heat-treated with a hot air at 250° C. for 2 min, and then, the loops were cut at one side to form hook engaging elements, thereby obtaining a hook surface fastener. The obtained hook engaging elements had a crystal orientation of 89.3%, a crystallinity of 39.2%, and a bending stiffness (flexural rigidity) of 0.017 gf·cm$^2$/cm.

The hook surface fastener obtained above and the loop surface fastener produced in the same manner as in Example 1 were measured for the engaging performance. The tensile shear strength was 8.9 N/cm$^2$ and the peeling strength was 1.6 N/cm. After repeating the engagement-disengagement operations 1000 times, the tensile shear strength was 5.3 N/cm$^2$ and the peeling strength was 1.0 N/cm. The retention of the engaging force after repeating the engagement-disengagement operations 1000 times was 60% or more, showing that the hook engaging elements were excellent also in the pull-out resistance.

After standing in a hot air at 230° C. for 24 h, the engaged hook surface fastener/loop surface fastener was measured at 20° C. for the engaging performance. The tensile shear strength was 8.6 N/cm$^2$, the peeling strength was 1.4 N/cm, and the retention of the engaging force under heating was 80% or more.

The hook surface fastener was brought into contact with the flame of a gas burner for 20 s. When separating the hook surface fastener from the flame, the fire extinguished oneself with little smoking, showing that the hook surface fastener was excellent also in the flame resistance.

Comparative Example 1

The following warp yarns, weft yarns and loop fibers were woven into a loop woven fabric in the same manner as in Example 1.

(1) Warp Yarns

PPS multifilaments (250 dtex/60 filaments) as used in Example 1.

(2) Weft Yarns: Non-Twisted, Paralleled Yarns

PPS multifilaments (167 dtex/10 filaments) as used in Example 1.

Heat-fusible multifilaments (84 dtex/24 filaments).

sheath component: low-melting point copolymerized PET (melting point: 155° C.) as used in Example 1.

core component: high-melting point non-copolymerized PET (melting point: 260° C.) as used in Example 1.

Amount of heat-fusible fibers used: 12% by weight of total weight of base fabric.

(3) Loop Fibers

PPS monofilaments having a diameter of 0.20 mm (380 dtex) as used in Example 1.

The obtained loop woven fabric was heat-treated with a hot air at 200° C. for 1 min, and then, the loops were cut at one side to form hook engaging elements, thereby obtaining a hook surface fastener. The obtained hook engaging elements had a crystal orientation of 90.3%, a crystallinity of 32.0%, and a bending stiffness (flexural rigidity) of 0.012 gf·cm$^2$/cm.

The hook surface fastener obtained above and the loop surface fastener produced in the same manner as in Example 1 were measured for the engaging performance. The tensile shear strength was 7.7 N/cm$^2$ and the peeling strength was 1.2 N/cm. After repeating the engagement-disengagement operations 1000 times, the tensile shear strength was 3.4 N/cm$^2$ and the peeling strength was 0.5 N/cm. The retention of the engaging force was as low as 50% or less, showing that the engaging performance was poor.

After standing in a hot air at 230° C. for 24 h, the engaged hook surface fastener/loop surface fastener was measured at 20° C. for the engaging performance. The tensile shear strength was reduced to 3.9 N/cm$^2$ and the peeling strength was reduced to 0.4 N/cm. In particular, the peeling strength was reduced to 50% or less of the level before the re-heat treatment, showing that the retention of the engaging force under heating was poor. After the re-heat treatment, a small number of the hooks retained its crook shape before the re-heat treatment, and this may reduce the easiness of engaging and the engaging strength.

Comparative Example 2

The following warp yarns, weft yarns and loop fibers were woven into a loop woven fabric in the same manner as in Example 1.

(1) Warp Yarns

PPS multifilaments (250 dtex/60 filaments) as used in Example 1.

(2) Weft Yarns: Non-Twisted, Paralleled Yarns

PPS multifilaments (167 dtex/10 filaments) as used in Example 1.

Heat-fusible fibers (84 dtex/48 filaments) as used in Example 1.

Amount of heat-fusible fibers used: 12% by weight of total weight of base fabric.

(3) Loop Fibers

PPS monofilaments having a diameter of 0.20 mm as used in Example 1.

The obtained loop woven fabric was heat-treated with a hot air at 270° C. for 1 min, and then, the loops were cut at one side to form hook engaging elements, thereby obtaining a hook surface fastener. The obtained hook engaging elements had a crystal orientation of 84.0%, a crystallinity of 44.0%, and a bending stiffness (flexural rigidity) of 0.019 gf·cm$^2$/cm.

The hook surface fastener obtained above and the loop surface fastener produced in the same manner as in Example 1 were measured for the engaging performance. The tensile shear strength was 9.5 N/cm$^2$ and the peeling strength was 1.4 N/cm. After repeating the engagement-disengagement operations 50 times, the tensile shear strength was 1.1 N/cm$^2$ and the peeling strength was 0.1 N/cm, showing that the engaging performance was almost completely lost. After 50-times engagement-disengagement operations, the shape of the hooks was substantially not changed. However, the hook engaging elements were brittle to result in a poor engaging performance.

Comparative Example 3

The following warp yarns, weft yarns and loop fibers were woven into a loop woven fabric in the same manner as in Example 1.

(1) Warp Yarns

PPS multifilaments (250 dtex/60 filaments) as used in Example 1.

(2) Weft Yarns: Twisted, Doubled Yarns (100 turn/m)

PPS multifilaments (167 dtex/10 filaments) as used in Example 1.

Heat-fusible multifilaments (84 dtex/24 filaments) as used in Comparative Example 1.

Amount of heat-fusible fibers used: 12% by weight of total weight of base fabric.

(3) Loop Fibers

PPS monofilaments having a diameter of 0.20 mm as used in Example 1.

The obtained loop woven fabric was heat-treated with a hot air at 250° C. for 1 min, and then, the loops were cut at one side to form hook engaging elements, thereby obtaining a hook surface fastener.

The hook surface fastener obtained above and the loop surface fastener produced in the same manner as in Example 1 were measured for the engaging performance. The tensile shear strength was 8.1 N/cm$^2$ and the peeling strength was 0.8 N/cm. After repeating the engagement-disengagement operations 50 times, the tensile shear strength was 1.1 N/cm$^2$ and the peeling strength was 0.1 N/cm, showing that the engaging performance was almost completely lost. The poor engaging performance is attributable to the insufficient anchoring of the hook engaging elements.

Comparative Example 4

The following warp yarns, weft yarns and loop fibers were woven into a loop woven fabric in the same manner as in Example 1.

(1) Warp Yarns

PPS multifilaments (250 dtex/60 filaments) as used in Example 1.

(2) Weft Yarns: Non-Twisted, Paralleled Yarns

PPS multifilaments (167 dtex/10 filaments: "Procon T/#7 G167-10-PFD" (tradename) manufactured by Toyobo Co., Ltd.).

Paralleled yarn (total fineness of 251 dtex/72 filaments) of heat-fusible multifilaments (167 dtex/48 filaments) as used in Example 2 and heat-fusible fibers (84 dtex/24 filaments) as used in Example 1.

Amount of heat-fusible fibers used: 30% by weight of total weight of base fabric.

(3) Loop Fibers

PPS monofilaments having a diameter of 0.20 mm as used in Example 1.

The fabric density was 52 yarns/cm for the warp yarns and 15 yarns/cm for the weft yarns. One loop monofilament was used per four warp yarns.

The obtained loop woven fabric was heat-treated with a hot air at 250° C. for 1 min, and then, the loops were cut at one side to form hook engaging elements (density: 43/cm$^2$), thereby obtaining a hook surface fastener.

Although the hand was rather hard because of the use of the heat-fusible fibers in a larger amount as compared with Example 1, the same engaging performance was obtained.

The hook surface fastener was brought into contact with the flame of a gas burner for 20 s. The flame still remained partly in the hook surface fastener even after separating the hook surface fastener from the flame, thereby showing no self-extinguishing characteristics.

Example 3

A hook surface fastener was produced in the same manner as in Example 1 except for heat-treating the loop woven fabric at 260° C. for 1 min. The obtained hook engaging elements had a crystal orientation of 88.3%, a crystallinity of 40.2%, and a bending stiffness (flexural rigidity) of 0.018 gf·cm$^2$/cm.

The hook surface fastener obtained above and the loop surface fastener produced in the same manner as in Example 1 were measured for the engaging performance. The tensile shear strength was 9.0 N/cm$^2$ and the peeling strength was 1.5 N/cm. After repeating the engagement-disengagement operations 1000 times, the tensile shear strength was 5.4 N/cm$^2$, the peeling strength was 0.9 N/cm, and the retention of the engagement-disengagement endurance was 60% or more.

After standing in a hot air at 230° C. for 24 h, the engaged hook surface fastener/loop surface fastener was measured at 20° C. for the engaging performance. The tensile shear strength was 8.7 N/cm$^2$, the peeling strength was 1.3 N/cm, and the retention of the engaging force under heating was 80% or more. No pull-out of the hook engaging elements was found.

The hook surface fastener was brought into contact with the flame of a gas burner for 20 s. When separating the hook surface fastener from the flame, the fire extinguished oneself with little smoking, showing that the hook surface fastener was excellent also in the flame resistance.

Example 4

A hook surface fastener was produced in the same manner as in Example 1 except for heat-treating the loop woven fabric at 240° C. for 1 min. The obtained hook engaging elements had a crystal orientation of 89.8%, a crystallinity of 33.2%, and a bending stiffness (flexural rigidity) of 0.016 gf·cm$^2$/cm.

The hook surface fastener obtained above and the loop surface fastener produced in the same manner as in Example 1 were measured for the engaging performance. The tensile shear strength was 8.0 N/cm$^2$ and the peeling strength was 1.1 N/cm. After repeating the engagement-disengagement operations 1000 times, the tensile shear strength was 5.5 N/cm$^2$, the peeling strength was 0.9 N/cm, and the retention of the engaging force was 60% or more.

After standing in a hot air at 230° C. for 24 h, the engaged hook surface fastener/loop surface fastener was measured at 20° C. for the engaging performance. The tensile shear strength was 7.0 N/cm$^2$, the peeling strength was 1.0 N/cm, and the retention of the engaging force under heating was 80% or more.

The hook surface fastener was brought into contact with the flame of a gas burner for 20 s. When separating the hook surface fastener from the flame, the fire extinguished oneself with little smoking, showing that the hook surface fastener was excellent also in the flame resistance.

INDUSTRIAL APPLICABILITY

According to the present invention, a hook surface fastener is provided, which is resistant to the reduction of the engaging performance because the shape of hooks is retained even at high temperatures as high as 250° C., excellent in the flame resistance and excellent in the pull-out resistance of the hook engaging elements. The hook surface fastener having a good heat resistance of the invention is suitably used, in addition to the surface fastener for domestic use, in the application requiring the heat resistance, for example, fastening means for fire-proof curtain, fire-proof wear, fireman uniform, high-temperature working wear, filter for high-temperature gas or liquid, and cushion for preventing scratching of products for high-temperature use.

What is claimed is:

1. A hook surface fastener comprising:

a base fabric; and hook engaging elements formed on the base fabric, wherein:

the base fabric is a woven fabric comprising warp yarns, weft yarns and fibers constituting the hook engaging elements, and the warp yarns and the fibers constituting the hook engaging elements are polyphenylene sulfide fibers;

the polyphenylene sulfide fibers constituting the hook engaging elements have a crystal orientation of 85.0 to 90.0% and a crystallinity of 32.0 to 42.0%;

the weft yarns are substantially non-twisted, paralleled yarns comprising polyphenylene sulfide fibers and heat-fusible fibers having a melting point or a softening point each being 230° C. or lower;

a ratio of the heat-fusible fibers to the fibers constituting the base fabric is 10 to 25% by weight wherein the fibers constituting the base fabric are total of the warp yarns and the weft yarns exclusive of the fibers constituting the hook engaging elements, and the fibers constituting the hook engaging elements are anchored to the base fabric by fusion of the heat-fusible fibers;

substantially no resin coat layer is provided on a back surface of the base fabric;

the polyphenylene sulfide fibers constituting the hook engaging elements are monofilaments of 200 to 600 dtex; and the fibers constituting the hook engaging elements are included in the base fabric as a part of the warp yarns.

2. The hook surface fastener according to claim 1, wherein the warp yarns are multifilaments of polyphenylene sulfide.

3. The hook surface fastener according to claim 1, wherein the weft yarns are substantially non-twisted, paralleled yarns comprising multifilaments of polyphenylene sulfide and heat-fusible multifilaments.

4. The hook surface fastener according to claim 1, wherein the heat-fusible fibers are core-sheath composite fibers comprising a core component of a high-melting point polyester and a sheath component of a low-melting point or low softening point polyester, the melting point or softening point of the sheath component being 230° C. or less.

* * * * *